US007416065B2

(12) United States Patent
Levinson et al.

(10) Patent No.: US 7,416,065 B2
(45) Date of Patent: Aug. 26, 2008

(54) SHOE CASE

(76) Inventors: Lawrence S. Levinson, 2702 Bristol Ct., Sugarland, TX (US) 77478; Alan D. Stanton, 201 Shasta, Houston, TX (US) 77024

( * ) Notice: Subject to any disclaimer, the term of this patent is extended or adjusted under 35 U.S.C. 154(b) by 760 days.

(21) Appl. No.: 11/023,325

(22) Filed: Dec. 27, 2004

(65) Prior Publication Data

US 2006/0137949 A1 Jun. 29, 2006

(51) Int. Cl.
*A47B 61/06* (2006.01)

(52) U.S. Cl. ..... 190/106; 206/286; 206/287; 190/18 A; 190/109

(58) Field of Classification Search ..... 190/106, 190/18 A, 109; 206/278, 286, 287
See application file for complete search history.

(56) References Cited

U.S. PATENT DOCUMENTS

| | | | | | |
|---|---|---|---|---|---|
| 746,617 | A | * | 12/1903 | Wenzell | 190/102 |
| 1,705,150 | A | | 3/1929 | Brady | |
| 1,921,110 | A | | 8/1933 | Wheary | |
| 1,968,580 | A | | 7/1934 | Wheary | |
| 2,517,757 | A | | 8/1950 | Adlerstein | |
| 2,585,745 | A | * | 2/1952 | Crosby | 190/111 |
| 2,634,835 | A | | 4/1953 | Mayers | |
| 2,698,689 | A | | 1/1955 | Novack | |
| 2,874,813 | A | | 2/1959 | Bunte | |
| 2,943,899 | A | | 7/1960 | Beller | |
| 3,001,650 | A | | 9/1961 | Turner | |
| 3,173,465 | A | * | 3/1965 | Pastini | 150/108 |
| 3,348,665 | A | | 10/1967 | Andretich | |
| 3,414,093 | A | | 12/1968 | Chostner | |
| 3,512,621 | A | * | 5/1970 | Teetor | 206/287 |
| 3,612,232 | A | * | 10/1971 | Larson | 206/287 |
| 3,858,693 | A | | 1/1975 | Dubenko | |
| 4,091,852 | A | * | 5/1978 | Jordan et al. | 383/3 |
| 4,134,479 | A | | 1/1979 | Crider, Jr. | |
| 4,542,825 | A | * | 9/1985 | Thomas et al. | 206/363 |
| 4,618,035 | A | * | 10/1986 | Mao | 190/18 A |
| 4,699,267 | A | | 10/1987 | Burke | |
| 5,064,061 | A | * | 11/1991 | Moxley | 206/289 |
| 5,474,163 | A | | 12/1995 | West et al. | |
| 5,588,529 | A | * | 12/1996 | Speck | 206/315.1 |
| 5,857,778 | A | * | 1/1999 | Ells | 383/5 |

FOREIGN PATENT DOCUMENTS

JP 2000-201720 A * 7/2000

* cited by examiner

*Primary Examiner*—Tri M Mai
(74) *Attorney, Agent, or Firm*—Clarence E. Eriksen

(57) ABSTRACT

A case for transporting shoes is disclosed which comprises front and back walls, top and bottom walls, and first and second side walls which define a chamber. The front and back walls, top and bottom walls and the first side wall are formed as an integral structure. The second side wall is hinged proximate the bottom wall to permit the second side wall to move from a closed position to an open position to permit access to the chamber. The chamber comprises a plurality of compartments for receiving shoes. The case includes two hooks which are disposed in substantially parallel relationship to one another and which can move from a retracted to an extended position for hanging the case. Transportation of the case is facilitated by wheels mounted proximate the intersection of the back and bottom walls, and by a handle which is movable from a retracted position inside the case to an extended position out the top of the case.

12 Claims, 2 Drawing Sheets

SHOE CASE

BACKGROUND OF THE INVENTION

1. Field of the Invention

The present invention relates to apparatus for use in transporting shoes.

2. Description of the Prior Art

When a person travels, it is often the case that he or she packs one or more pair of shoes in addition to the ones being worn. It is common for shoes to be packed in a suitcase along with the traveler's clothes and other articles, and such packing of shoes tends to be done in a random, as opposed to an organized, manner. Shoes can take up a substantial amount of suitcase space, and the random packing of shoes in a suitcase most likely results from the traveler endeavoring to make an efficient use of available suitcase space. Additionally, packing shoes a suitcase often requires the traveler to put the shoes in a plastic bag or the like to prevent polish or dirt on the shoes from soiling the traveler's clothes which are also packed in the suitcase.

Upon arrival of his or her destination, the traveler does not usually have a convenient place in which to keep the shoes. The traveler may, for example, opt either to live out of a suitcase and to remove a given pair of shoes from the suitcase as needed or to strew the shoes in a random, haphazard manner on the floor of the room or a closet. Neither of these alternatives is convenient.

Various approaches have been suggested for transporting shoes; however, these approaches have focused on providing shoe cases which are in the form of a standard type suitcase. Examples of such shoe cases are shown in U.S. Pat. Nos. 1,705,150; 1,921,110; 1,968,580; 2,634,835; 2,698,689; 2,874,813; 3,001,650; 3,414,093; and 4,699,267. None of the shoe cases described in the above-identified patents adequately solve the problem of providing a convenient mechanism for transporting the shoes and having them be conveniently available to the traveler upon arrival at his or her destination. That novel and useful result has been achieved by the apparatus of the present invention.

SUMMARY OF THE INVENTION

In accordance with the present invention, a case is provided for transporting shoes which comprises front and back walls, top and bottom walls and first and second side walls which define a chamber. The front and back walls, the top and bottom walls and the first sidewall are formed as an integral structure. The second side wall is hinged near the bottom wall to allow the second side wall to pivot from a closed position to an open position to permit access to the chamber.

A shoe case in accordance with the present invention further comprises a plurality of compartments for receiving shoes. In one embodiment, a case in accordance with the present invention comprises ten such compartments, while in another embodiment, a case in accordance with the present invention comprises six such compartments.

A case in accordance with the present invention further comprises two hooks which are disposed in a substantially parallel relationship to one another. One hook is located proximate the front wall of the case, while the other hook is located proximate the back wall of the case. Each hook is movable from a retracted position inside the case to an extended position out the top wall of the case. In their extended position, the hooks may be advantageously used to hang the case, for example, on the dowel bar in a closet.

A case in accordance with the present invention may further comprise wheels which are attached proximate the intersection of the back and bottom walls, and a handle which is movable from a retracted position inside the case to an extended position out the top wall of the case.

A case in accordance with the present invention further comprises apparatus for connecting the second side wall to the front and back walls. Such apparatus may, for example, comprise a zipper, one or more snaps or Velcro strips.

A case in accordance with the present invention further comprises apparatus for connecting the second side wall to the top wall. Such apparatus may, for example, comprise Velcro strips, at least one snap or clasp.

DESCRIPTION OF SPECIFIC EMBODIMENTS

It will be appreciated that the present invention may take many forms and embodiments. Some embodiments are described so as to give an understanding of the invention. It is intended that the embodiments of the invention described herein are illustrative and not limiting of the invention.

Figure 1:
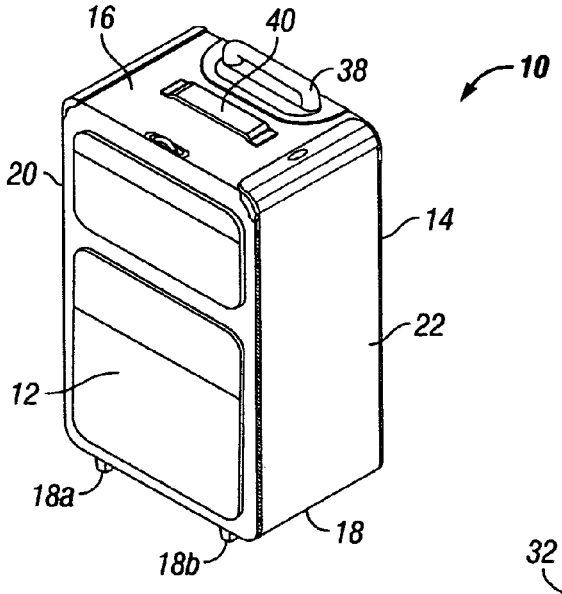
FIG. 1 is a perspective view of a shoe case in accordance with the present invention.
Figure 2:
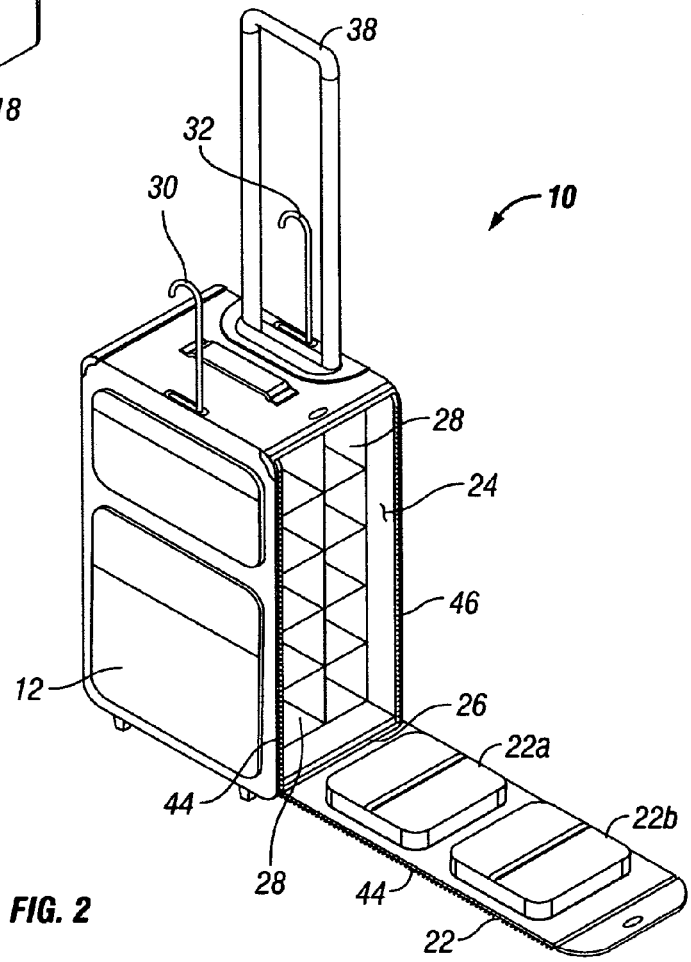
FIG. 2 is a perspective view of the shoe case of FIG. 1 with the hinged side wall in an open position.

With reference first to FIGS. 1 and 2, a shoe case 10 in accordance with the present invention is illustrated. Shoe case 10 comprises front wall 12 and back wall 14, top wall 16 and bottom wall 18 and first and second side walls 20 and 22, respectively. Front and back walls 12 and 14, top and bottom walls 16 and 18, and the first and second walls 20 and 22 define a chamber 24 for receiving shoes. Front and back walls 12 and 14, top and bottom walls 16 and 18 and first side wall 20 are preferably formed as an integral structure. Second side wall 22 is hinged at 26 near the bottom wall 18 to permit the second side wall 22 to pivot from a closed position (FIG. 1) to an open position (FIG. 2) to permit access to chamber 24.

Chamber 24 includes a plurality of compartments 28 for receiving shoes In the embodiment of illustrated in FIG. 2, the shoe case 10 has ten compartments for receiving shoes. In second embodiment, the upper four compartments 28 illustrated in FIG. 2 are removable when a six compartment case is desired. The compartments 28 may be fabricated from a suitable rigid material, e.g. plastic, or from a flexible cloth material.

One or more pockets 22*a*, 22*b* may be formed on the inside of the second side wall 22 for holding jewelry or small clothing items.

With reference still to FIGS. 1 and 2, a shoe case 10 in accordance with the present invention comprises two hooks 30 and 32. Hooks 30 and 32 are displaced in a substantially parallel relationship to one another, with hook 30 being positioned proximate from wall 12 and hook 32 being positioned proximate back wall 14. Each hook 30, 32 is movable from a retracted position inside case 10 (FIG. 1) to an extended position out the top wall 16 of case 10 (FIG. 2). In this extended position, hooks 30 and 32 may advantageously be used to hang case 10 on a dowel rod 42 as is commonly found in a closet.

Figure 3:
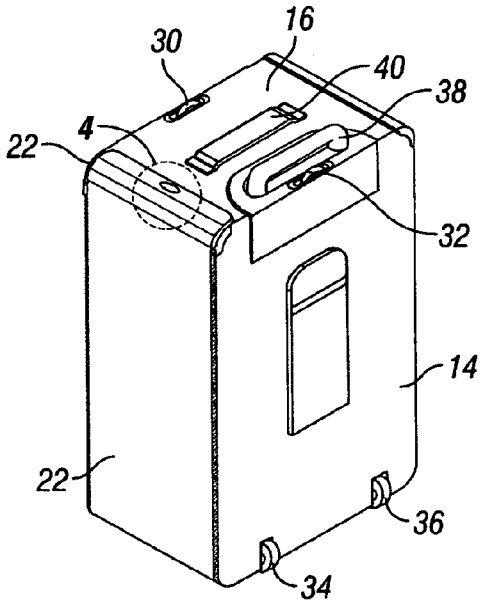
FIG. 3 is a perspective view of the shoe case of FIG. 1 which illustrates the case from the rear.

With reference to FIGS. 1, 2 and 3, a shoe case 10 in accordance with the present invention may further comprise wheels 34 and 36 to facilitate transportation of the case. Wheels 34 and 36 are located proximate the intersection of back wall 14 and bottom wall 18 as illustrated in FIG. 3. The case 10 also comprises a handle 38 which is movable from a retracted position inside the case 10 (FIGS. 1 and 3) to an extended position out the top wall of the case 10 (FIG. 2). The handle 38 may be fabricated from any suitable material, e.g. metal or plastic. If the traveler does not wish to roll the shoe case 10, it may be carried using handle 40.

Figure 5:
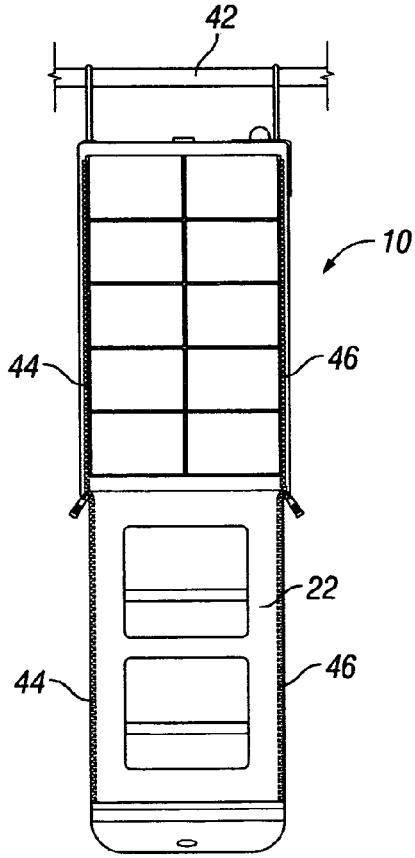
FIG. 5 is a side elevation view of the case of FIG. 1 with the case being hung on a closet dowel rod and with the hinged side wall open.

With reference to FIGS. 2, 3 and 5, a case 10 in accordance with the present invention further comprises apparatus from connecting the second side wall 22 to the front and back walls 12 and 14 when the second side wall is in the closed position as in FIG. 3. In one embodiment, this apparatus for connecting the second side wall 22 to front and back walls 12 and 14 comprises zippers 44 and 46. Zipper 44 is connected to an edge of front wall 12 and the front wall edge of second side wall 22. Zipper 46 is connected to an edge of back wall 14 and the back wall edge of second sidewall 22. Alternatively, second side wall 22 may be connected to the front and back walls 12 and 14 using snaps or Velcro strips.

Figure 4A:
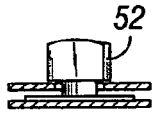
FIGS. 4A, 4B and 4C illustrate various types of apparatus for use in connecting the top of the hinged side wall to the top wall of the case.
Figure 4B:
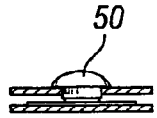
Figure 4C:
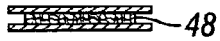

With reference to FIGS. 3 and 4A, 4B and 4C, a case 10 in accordance with the present invention further comprises apparatus 4 for connecting the second side wall 22 to top wall 16. Second side wall 22 includes a flap 22C which extends onto the top wall 16. The second side wall 22 may be connected to the top wall 16 by using Velcro strips 48 (FIG. 4C), a snap 50 (FIG. 4B) or a clasp 52 (FIG. 4A).

A shoe case 10 in accordance with the present invention preferably has a height width and depth such that the case may fit under the seat in a commercial aircraft. In one embodiment, shoe case 10 has a height of 22 inches, a width of 14 inches and a depth of 9 inches.

A shoe case 10 in accordance with the present invention has a number of advantages not heretofore available. For example, shoe case 10 with compartments 28 permits the traveler to pack a plurality of pairs of shoes neatly and without concern that the packed shoes may soil any clothing which is also packed. Further, upon arrival at his or her destination, the traveler is able to hang case 10 and to store shoes neatly in case 10 which are not being worn.

What is claimed is:

1. A case for transporting shoes, comprising:

front and back walls, top and bottom walls and two side walls which define a chamber, the front and back walls, top and bottom walls and one of the side walls being formed as an integral structure, and the second side wall being hinged near the bottom wall to allow the second side wall to pivot from a closed position to an open position to permit access to the chamber;

a plurality of compartments in the chamber for receiving shoes;

two hooks which are disposed in a substantially parallel relationship to one another and which are movable from a retracted position inside the case to an extended position out the top wall of the case for hanging the case;

wheels which are attached proximate the intersection of the back wall and bottom wall; and a handle which is movable from a retracted position inside the case to an extended position out the top wall of the case.

2. The case of claim 1, wherein the chamber comprises ten compartments for receiving shoes.

3. The case of claim 1, wherein the chamber comprises six compartments for receiving shoes.

4. The case of claim 1, wherein it has a length, width and depth such that the case is able to fit under the seat in an aircraft.

5. The case of claim 1, further comprising apparatus for connecting the second side wall to the back and front walls.

6. The case of claim 5, wherein the connecting apparatus comprises at least one zipper.

7. The case of claim 5, further comprising means for connecting the second side wall to the top wall of the case.

8. The case of claim 7, wherein the means for connecting the second side wall to the top wall comprises at least one snap.

9. The case of claim 7, wherein the means for connecting comprises a clasp on the top wall and a hole forward in the second side wall for engaging said clasp.

10. A case for transporting shoes, comprising:

front and back walls, top and bottom walls and two side walls which define a chamber, the front and back walls, top and bottom walls and one of the side wall being formed as an integral structure, and the second side wall being hinged near the bottom wall to allow the second side wall to pivot from a closed position to an open position to permit access to the chamber;

a plurality of compartments in the chamber for receiving shoes;

two hooks which are disposed in a substantially parallel relationship to one another and which are movable from a retracted position inside the case to an extended position out the top wall of the case for hanging the case;

wheels which are attached proximate the intersection of the back wall and the bottom wall;

a handle which is movable from a retracted position inside the case to an extended position out the top of the case; and apparatus for connecting the second side wall to the front, back and top walls of the case.

11. The case of claim 10, wherein the chamber comprises six compartments for receiving shoes.

12. The case of claim 10, wherein the chamber comprises ten compartments for receiving shoes.

* * * * *